US006838606B2

(12) United States Patent
Chiang

(10) Patent No.: US 6,838,606 B2
(45) Date of Patent: Jan. 4, 2005

(54) DRUM HAVING DECORATIVE HEADS

(76) Inventor: Kuei Mei Chiang, No. 119, Zhenxin Rd., Taizhong (TW)

( * ) Notice: Subject to any disclaimer, the term of this patent is extended or adjusted under 35 U.S.C. 154(b) by 118 days.

(21) Appl. No.: 10/347,758

(22) Filed: Jan. 21, 2003

(65) Prior Publication Data

US 2004/0139839 A1 Jul. 22, 2004

(51) Int. Cl.[7] ..... G10D 13/02
(52) U.S. Cl. ..... 84/414; 84/411 R
(58) Field of Search ..... 84/414, 411 R

(56) References Cited

U.S. PATENT DOCUMENTS 4,706,540 A * 11/1987 Donohoe ..... 84/414
4,979,422 A * 12/1990 Belli ..... 84/414
5,581,044 A * 12/1996 Belli et al. ..... 84/414
6,291,753 B1 * 9/2001 Campbell et al. ..... 84/411 M
6,297,177 B1 * 10/2001 Belli et al. ..... 442/242
6,365,812 B1 * 4/2002 McGill ..... 84/414

* cited by examiner

*Primary Examiner*—Shih-Yung Hsieh
(74) *Attorney, Agent, or Firm*—Birch, Stewart, Kolasch & Birch, LLP

(57) ABSTRACT

A drum includes a shell with two heads fixedly connected to two opposite ends of the shell by two counterhoops. Each head includes a base, a decoration layer on the base, a protection layer on the decorative layer and a durable layer on the protection layer. The durable layer has ridges extending therefrom so that the patterns on the decorative layer looks like flapping when the head is beat.

1 Claim, 8 Drawing Sheets

DRUM HAVING DECORATIVE HEADS

FIELD OF THE INVENTION

The present invention relates to a drum having two heads each comprises a base, a decorative layer, a protection layer and a durable layer which has straight ridges spread on the outer surface thereof.

BACKGROUND OF THE INVENTION

A conventional drum 50 is shown in FIG. 9 and generally includes a shell 51 with two heads 52 on two opposite sides of the shell 51 and the two heads 52 are secured by two counterhoops 53 which tighten the heads 52 so that when beating the heads 52, an expected sound may produce. The heads 52 are usually colored with a light color and this makes the drum boring in view of aesthetic. Some manufacturers print their brand names or logos on the heads 52, the printed material on the heads 52 fade out and get dirty easily. Yet some manufacturers stick a decorative label on the heads 52. The glue could hardened exposed in the sunshine and rains so that the decorative labels are peeled off after a period of time of use.

The present invention intends to provide a drum having transparent heads each of which includes a base, a decorative layer, a protection layer and a durable layer which has straight ridges spread on the outer surface thereof so that the patterns on the decorative layer can be protected and the parallel ridges makes the patterns look like flapping.

SUMMARY OF THE INVENTION

In accordance with one aspect of the present invention, there is provided a drum which comprises a shell having two heads connected to two opposite ends of the shell by two counterhoops. Each of the heads includes a base, a decoration layer on the base, a protection layer on the decorative layer and a durable layer on the protection layer. The durable layer has ridges extending therefrom.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
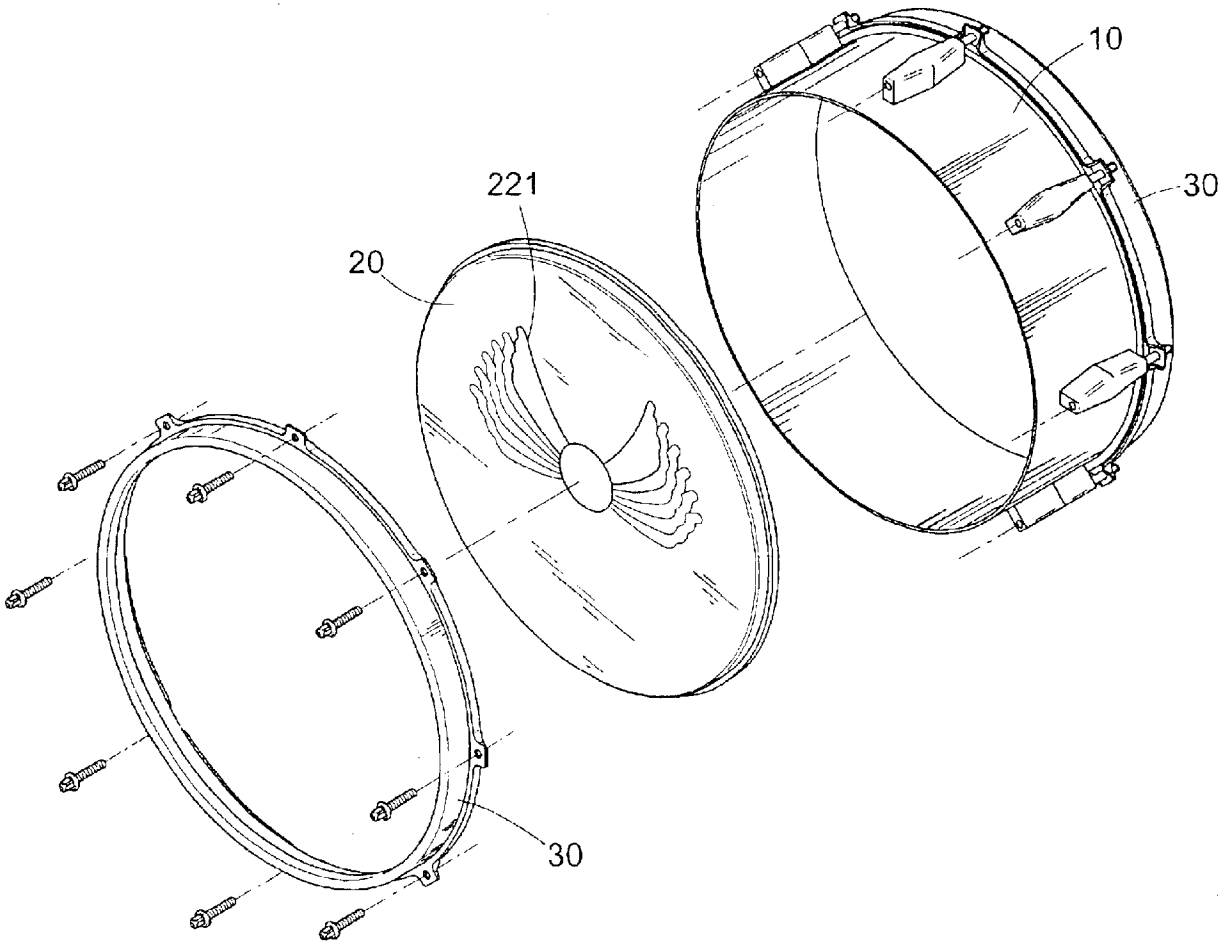
FIG. 1 is an exploded view to show the drum of the present invention.
Figure 2:
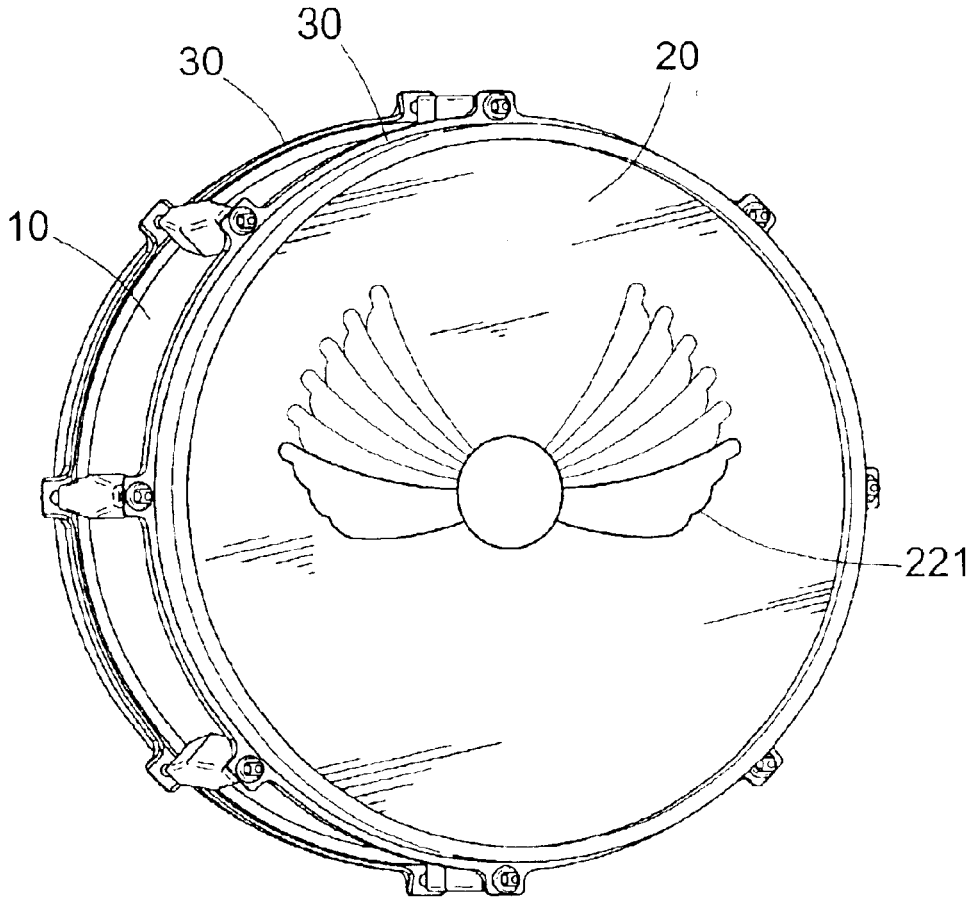
FIG. 2 is a perspective view to show the drum of the present invention.
Figure 3:
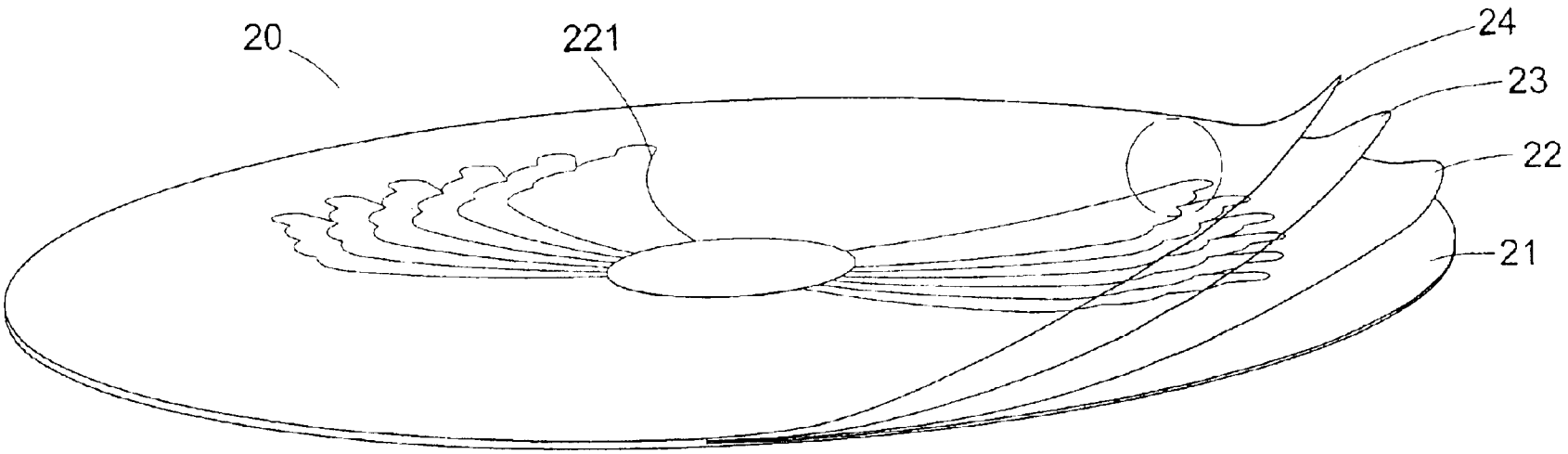
FIG. 3 shows the layers of the head of the drum of the present invention.
Figure 4:
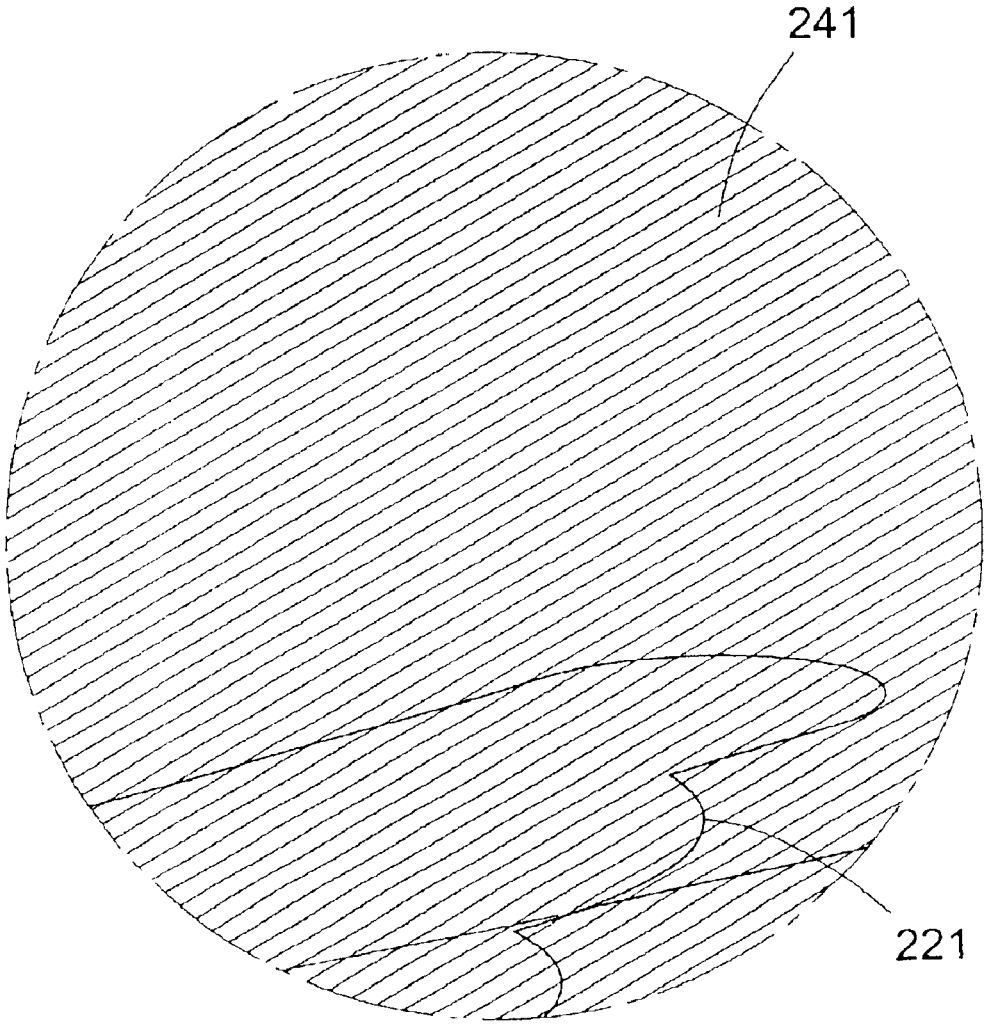
FIG. 4 shows the pattern can be seen from the durable layer having ridges.
Figure 5:
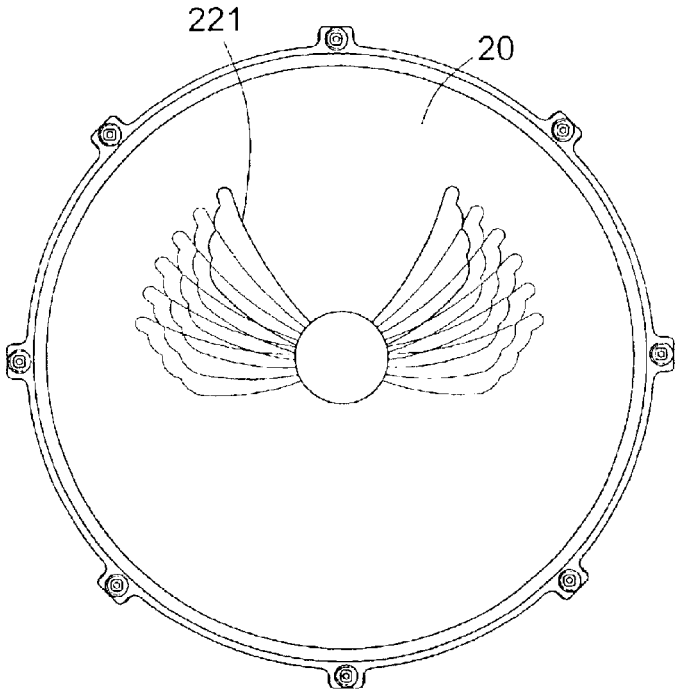
FIGS. 5 and 6 show the pattern on the head of the drum of the present invention.
Figure 6:
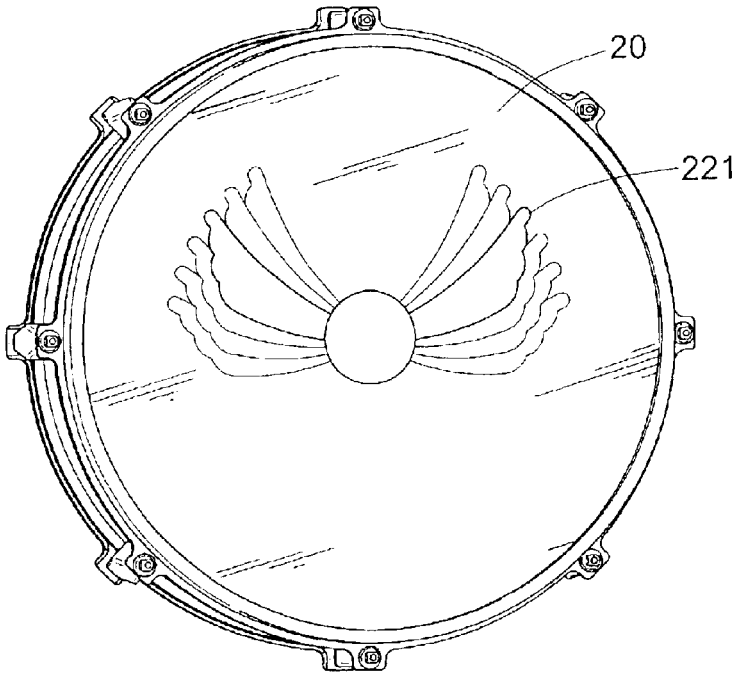

Referring to FIGS. 1, 2, 3, 5 and 6, the drum of the present invention comprises a shell 10 having two transparent heads 20 connected to two opposite ends of the shell 10 and two counterhoops 30 position the heads 20 on the shell 10. Each of the heads 20 includes a base 21, a decoration layer 22 having a pattern 221 on the base 21, a protection layer 23 on the decorative layer 22, and a durable layer 24 on the protection layer 23. Referring to FIG. 4, the durable layer 24 has parallel ridges 241 extending therefrom so that the pattern 221 can be seen via the ridges 241 which are transparent. The serrated surface made by the ridges 241 provides a special sight feature that makes the pattern 221 has a depth of field.

Figure 7:
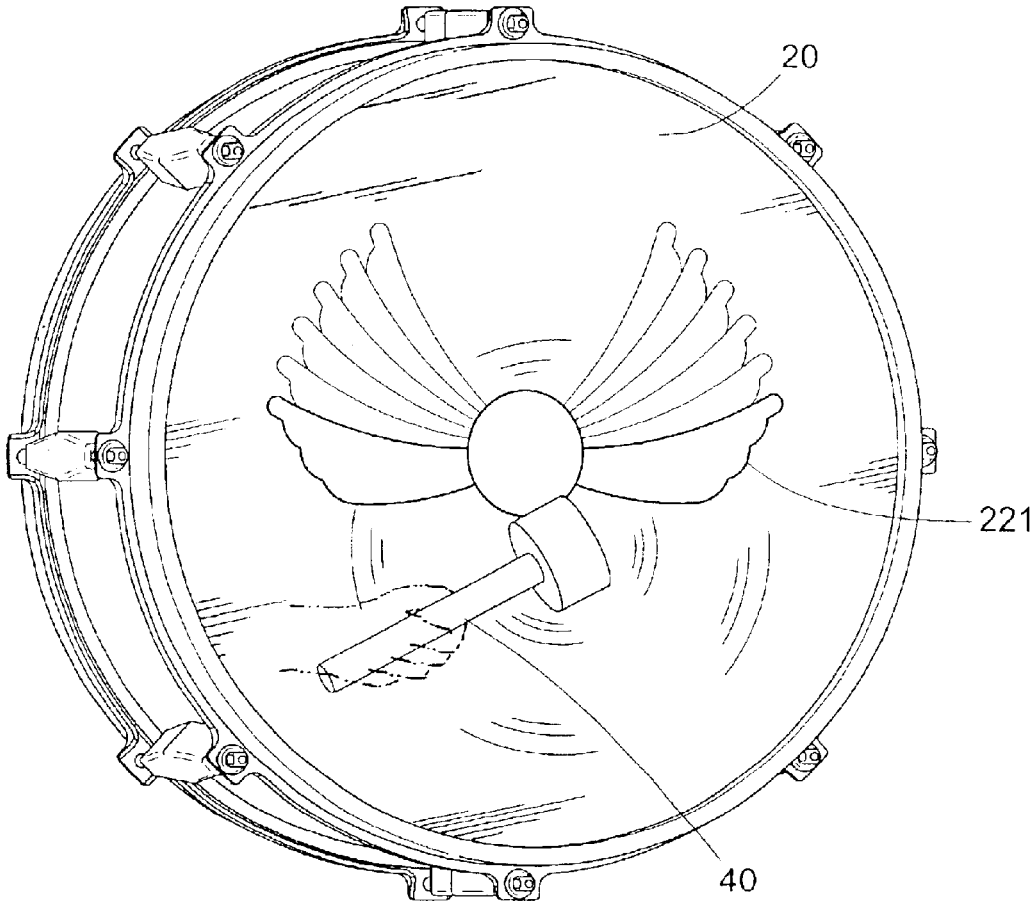
FIG. 7 shows a beater is hitting the head.
Figure 8:
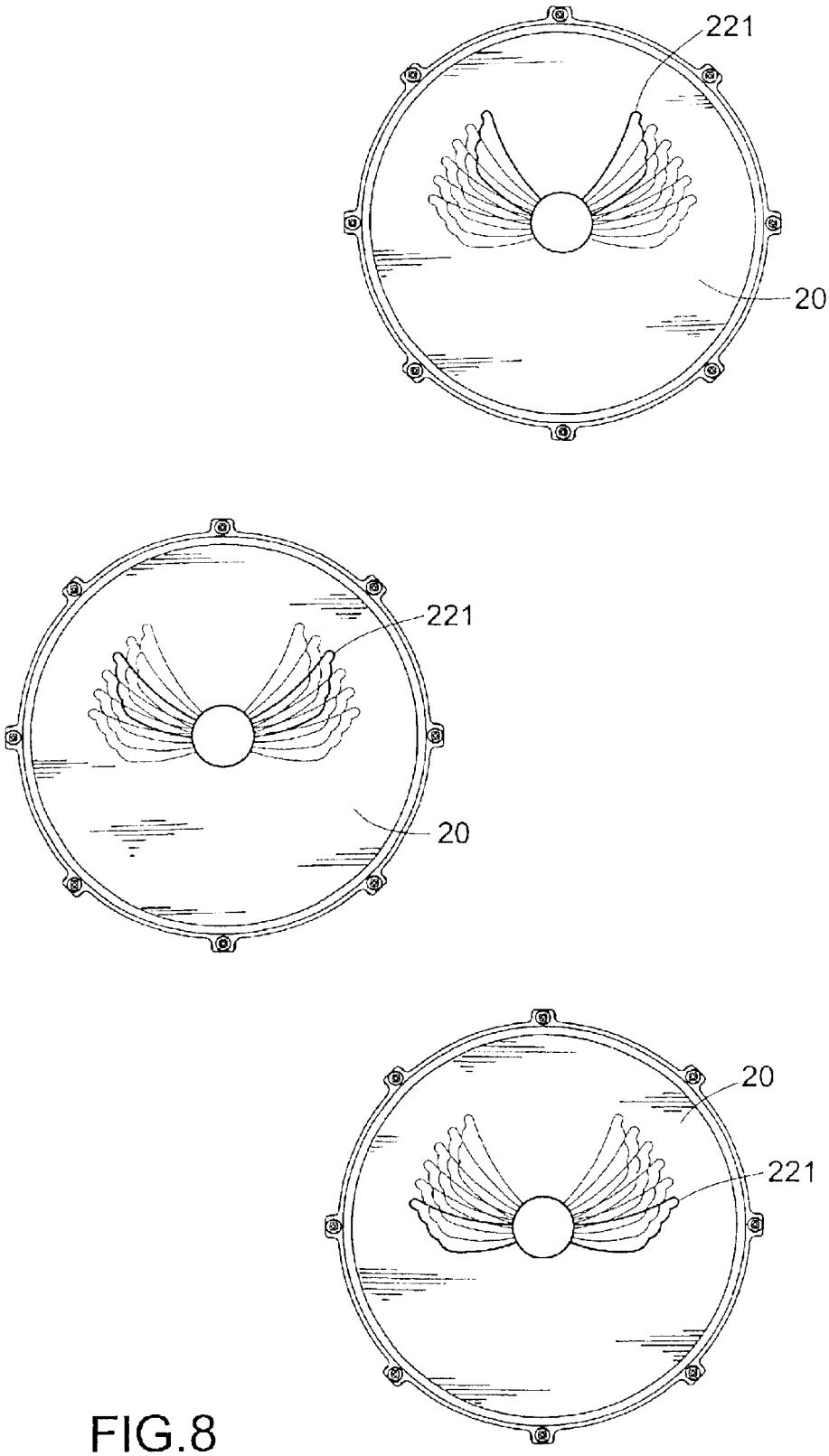
Figure 9:
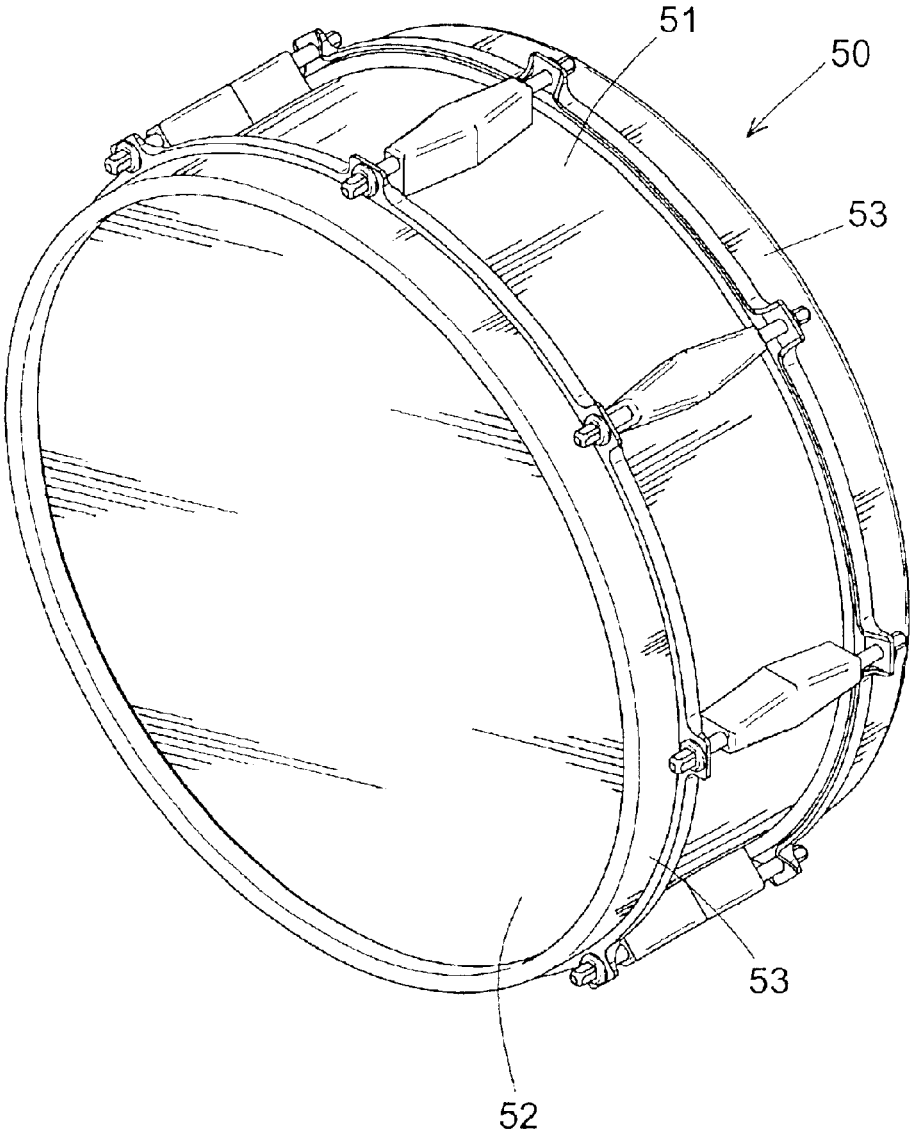
PRIOR ART FIG.9
FIG. 9 shows a conventional drum.

Referring to FIGS. 7 and 8, when the head 20 is beat by a beater 40, the head 20 vibrates and the ridges 241 shakes at a high frequency and the vibration makes the pattern 221 move like flapping. This durable layer 24 prevents the head 20 from being damaged and enriches the aesthetic function of the drum.

While we have shown and described the embodiment in accordance with the present invention, it should be clear to those skilled in the art that further embodiments may be made without departing from the scope of the present invention.

What is claimed is:

1. A drum comprising:

a shell having two heads connected to two opposite ends of the shell and two counterhoops positioning the heads on the shell, each of the heads including a base, a decoration layer on the base, a protection layer on the decorative layer and a durable layer on the protection layer, the durable layer having ridges extending therefrom.

* * * * *